US009771241B2

(12) United States Patent
Varelius et al.

(10) Patent No.: US 9,771,241 B2
(45) Date of Patent: Sep. 26, 2017

(54) ELEVATOR SYSTEM AND METHOD FOR INSTALLING AN ELEVATOR

(71) Applicants: Ari Varelius, Espoo (FI); Juha Panula, Hameenlinna (FI)

(72) Inventors: Ari Varelius, Espoo (FI); Juha Panula, Hameenlinna (FI)

(73) Assignee: KONE CORPORATION, Helsinki (FI)

( * ) Notice: Subject to any disclaimer, the term of this patent is extended or adjusted under 35 U.S.C. 154(b) by 19 days.

(21) Appl. No.: 14/797,995

(22) Filed: Jul. 13, 2015

(65) Prior Publication Data

US 2015/0314987 A1 Nov. 5, 2015

Related U.S. Application Data

(63) Continuation of application No. PCT/FI2014/050042, filed on Jan. 20, 2014.

(30) Foreign Application Priority Data

Feb. 1, 2013 (FI) ..... 20135104

(51) Int. Cl.
*B66B 1/50* (2006.01)
*B66B 19/00* (2006.01)
(Continued)

(52) U.S. Cl.
CPC ..... *B66B 1/50* (2013.01); *B66B 1/40* (2013.01); *B66B 5/0018* (2013.01); *B66B 19/00* (2013.01)

(58) Field of Classification Search
CPC B66B 1/50; B66B 1/40; B66B 5/0018; B66B 19/00
(Continued)

(56) References Cited

U.S. PATENT DOCUMENTS 3,051,269 A * 8/1962 Guilbert, Jr. ..... B66B 13/06 187/319
6,526,368 B1 2/2003 Coste et al.
(Continued)

FOREIGN PATENT DOCUMENTS

CN 85107638 A 5/1986
GB 2166711 A 5/1986
(Continued)

OTHER PUBLICATIONS

Office Action dated Dec. 14, 2016 by the Patent Office of SIPO for the corresponding Chinese Application No. CN2014800069397.
(Continued)

*Primary Examiner* — Michael Riegelman
(74) *Attorney, Agent, or Firm* — Harness, Dickey & Pierce, P.L.C.

(57) ABSTRACT

The elevator system includes an elevator hoistway bounded by a surrounding structure, two or more entrances to the elevator hoistway, guide rails, which are fitted into the elevator hoistway and also an elevator car with door(s), which elevator car is configured to be movable in the elevator hoistway between the aforementioned entrances to the elevator hoistway along a vertical trajectory determined by the guide rails. Each entrance to the elevator hoistway may be bounded by a door frame, onto which a hoistway door is fitted. The door opening of the elevator car may be bounded by a door frame, onto which the car door is fitted. The elevator system includes for each entrance to the elevator hoistway a marking piece fixed immovably to the frame of the hoistway door, wherein the marking piece indicates the location in the elevator hoistway of the entrance to the elevator hoistway. The elevator system may also include a reader moving along with the elevator car, wherein the reader may be fixed immovably to a fixing point
(Continued)

on the frame of the car door and may be configured to read the marking piece.

11 Claims, 2 Drawing Sheets

(51) Int. Cl.
*B66B 5/00* (2006.01)
*B66B 1/40* (2006.01)

(58) Field of Classification Search
USPC ..... 187/334
See application file for complete search history.

(56) References Cited

U.S. PATENT DOCUMENTS 6,701,277 B2 3/2004 Coste et al.
7,540,357 B2 6/2009 Finn et al.
7,540,358 B2 6/2009 Okamoto et al.
7,621,379 B2 * 11/2009 Miller ..... B66B 13/24 187/330
7,669,698 B2 3/2010 Jahkonen
2002/0193963 A1 12/2002 Coste et al.
2006/0243537 A1 11/2006 Finn et al.
2006/0289241 A1 12/2006 Okamoto et al.
2009/0166134 A1 7/2009 Jahkonen
2012/0048657 A1 * 3/2012 Christen ..... B66B 13/08 187/330
2012/0318616 A1 * 12/2012 Carparelli ..... B66B 13/08 187/334
2014/0231183 A1 * 8/2014 Halonen ..... B66B 11/0226 187/334
2014/0251735 A1 * 9/2014 Anttila ..... B66B 9/00 187/254
2016/0185569 A1 * 6/2016 Sonnenmoser ..... B66B 5/0025 187/393
2017/0015521 A1 * 1/2017 Toutaoui ..... B66B 5/0018

FOREIGN PATENT DOCUMENTS

WO WO-0170613 A1 9/2001
WO WO-2006080633 A1 8/2006
WO WO-2007144449 A1 12/2007
WO WO-2010018298 A1 2/2010

OTHER PUBLICATIONS

International Search Report PCT/ISA/210 for International Application No. PCT/FI2014/050042 Dated Apr. 22, 2014.

* cited by examiner

ELEVATOR SYSTEM AND METHOD FOR INSTALLING AN ELEVATOR

This application is a continuation of PCT International Application No. PCT/FI2014/050042 which has an International filing date of Jan. 20, 2014, and which claims priority to Finnish patent application number 20135104 filed Feb. 1, 2013, the entire contents of both of which are incorporated herein by reference.

FIELD OF THE INVENTION

Example embodiments relate to solutions for positioning an elevator car.

BACKGROUND

An elevator car moves in an elevator hoistway in a vertical direction along a trajectory determined by the guide rails of the elevator car. In some embodiments the position of the elevator car in the elevator hoistway is measured with a magnetic switch moving along with the elevator car, which magnetic switch reacts to permanent magnets fitted into the elevator hoistway alongside the trajectory of the elevator car when the magnetic switch is situated in the immediate proximity of a permanent magnet. Permanent magnets are usually fastened by the aid of their magnetic force of attraction to a guide rail of the elevator car and a magnetic switch is disposed next to the guide rail. The permanent magnets can be disposed e.g. in such a way that they indicate the position of the elevator car in the door zone, i.e. at that point of the elevator hoistway in which passengers are able to transfer from the stopping floor into the elevator car and also to exit from the elevator car to the stopping floor. In this case the elevator car starts moving from the point of the magnet and stops at the point of the magnet in the elevator hoistway.

If a permanent magnet is located at an incorrect point of the guide rail, the elevator car will stop at the wrong point. In this case a step forms between the stopping floor and the floor of the elevator car, which step makes the transfer of passengers between the elevator car and the stopping floor awkward, causing inter alia a risk of tripping. A step also impedes e.g. the transfer of a wheelchair or castor pallet into the elevator car or out of the elevator car. For this reason an elevator fitter must adjust the position of the magnets indicating the location of the door zone by moving each magnet, e.g. from the roof of the elevator car in such a way that the step between the floor of the elevator car and the stopping floor is eliminated. This work phase lengthens the installation time of the elevator. In addition, the position of the magnets might change also during operation of the elevator, e.g. owing to vibration, air flow, et cetera, in which case a serviceman must visit the elevator to rectify the position of the magnets.

SUMMARY

The elevator system comprises an elevator hoistway bounded by a surrounding structure, two or more entrances to the elevator hoistway, guide rails, which are fitted into the elevator hoistway and also an elevator car with door(s), which elevator car is configured to be movable in the elevator hoistway between the aforementioned entrances to the elevator hoistway along a vertical trajectory determined by the guide rails. In the elevator system each aforementioned entrance to the elevator hoistway is bounded by a door frame, onto which a hoistway door is fitted. The aforementioned door frame of the hoistway door is formed from a horizontal door header and a horizontal lower frame member as well as side frame members connecting them. In the elevator system the door opening of the elevator car is bounded by a door frame, onto which the car door is fitted. The aforementioned frame of the car door is formed from a horizontal door header and a horizontal lower frame member as well as side frame members connecting them. The elevator system comprises for each aforementioned entrance to the elevator hoistway a marking piece indicating the location in the elevator hoistway of the entrance to the elevator hoistway, which marking piece is fixed immovably to a fixing point in the door header of the hoistway door. The elevator system further comprises a reader moving along with the elevator car, said reader being immovably fixed to a fixing point on the door header of the car door and being configured to read the aforementioned marking piece when the reader has reached the individual reading point for the marking piece in the elevator hoistway. Each aforementioned frame of a hoistway door is matched to the frame of the car door in such a way that the interpositioning of the fixing point of a marking piece on the door header of a hoistway door and the fixing point of the reader on the door header of the car door is constant when the top surface of the bottom frame member of the car door is situated at the same height as the top surface of the bottom frame member of the hoistway door. By fixing the marking piece and the reader immovably to the horizontal door headers, extremely good accuracy is achieved for the vertical position of the marking piece and of the reader.

In the description the phrase "the frame of a hoistway door is matched to the frame of the car door" means that the dimensions of the frame of a hoistway door are selected to be compatible with the dimensions of the frame of the car door, in which case the location of the marking piece to be fixed to the frame of a hoistway door in relation to the reader to be fixed to the frame of the car door is explicitly determined. By matching the frame of a hoistway door to the frame of the car door it can consequently be ensured that the marking piece immovably fixed to the frame of a hoistway door indicates to the reader at exactly the point of it in the elevator hoistway that the top surface of the bottom frame member of the hoistway door and the top surface of the bottom frame member of the car door are at the same height. In a preferred embodiment of the invention the top surface of the bottom frame member of a hoistway door is on the same level as the stopping floor and the top surface of the bottom frame member of car door is on the same level as the floor of the elevator car. A height difference between the top surface of the bottom frame member of a hoistway door and the top surface of the bottom frame member of the car door will cause a step between the stopping floor and the floor of the car. In the solution according to the invention in a normal situation a step caused by erroneous positioning of a marking piece is not able to form between a stopping floor and the floor of the car door, so that installation of the elevator does not require a separate work phase for correcting/adjusting the vertical location of the aforementioned marking piece.

Example embodiments provide that the guide rails of the elevator car are situated in such a way that when the elevator car is in a door zone the frame of the car door and the frame of the hoistway door are situated face-to-face in the immediate proximity of each other. This is important also from the viewpoint of safety, so that the formation of the type of gap between the door frames in which a body part or a movable object could be wedged can be prevented.

The horizontal position of each marking piece can be inspected e.g. with a plumb line, in which case the marking pieces on different floors must be situated on the same vertical line determined by the plumb line. The horizontal location of a marking piece is not, however, as critical as the vertical location of the marking piece, because it is primarily an error in the vertical location of a marking piece that causes a step between the stopping floor and the floor of the car. By increasing the horizontal width of the marking piece, in some cases also a certain error in the horizontal location of the marking piece can also be permitted.

In an example embodiment, the frame of a hoistway door and the frame of the car door are assembled from element pieces. In one preferred embodiment the dimensions of the element pieces forming the frame of a hoistway door are matched to the dimensions of the element pieces forming the frame of the car door. By using element pieces it can be ensured that the dimensions of the door frames are matched with each other already in the manufacturing phase of the element pieces, and the aforementioned matching work no longer needs to done at the installation site of the elevator.

In an example embodiment, the location of the fixing point of a marking piece on an element piece of a frame of a hoistway door is matched to the fixing point of the reader on the element piece of the frame of the car door.

In an example embodiment, the aforementioned marking piece is immovably attached to a base plate, which is fixed to a support arm, which is further immovably fixed to the frame of a hoistway door at the point of the fixing point on the frame.

In an example embodiment, the base plate comprises two fixing holes and also two fixing grooves, and the base plate is configured to be fixed to a support arm either with a non-adjustable fixing method at the point of the fixing holes or alternatively with an adjustable fixing method at the point of the fixing grooves.

In an example embodiment, the fixing holes and the fixing grooves are disposed in opposite ends of the base plate.

In an example embodiment, the aforementioned base plate is fixed immovably to a support arm.

In an example embodiment, the support arm continues to the side of the door header of a hoistway door in such a way that the marking piece fixed to the support arm is at least partly situated on the same plane in the vertical direction as the frame of the hoistway door. In one preferred embodiment the reader is fixed to the door header of the car door with a support arm, which continues to the side of the door header of the car door in such a way that the reader fixed to the support arm is at least partly situated on the same plane in the vertical direction as the frame of the car door. In this way the formation of the type of gap between door frames facing each other, in which a body part or a movable object could be wedged, can be prevented in a space-efficient manner.

In an example embodiment, the fixing of the aforementioned marking piece is implemented without an adjustment device for the location of the marking piece.

In an example embodiment, the marking piece comprises a floor marking for individualizing a stopping floor of the elevator, and the reader is configured to read the aforementioned floor marking.

In an example embodiment, guide shoes are fitted in connection with the elevator car, which guide shoes are configured to move along the guide rails of the elevator car.

In an example embodiment, the door of the elevator car is an automatic door.

In an example embodiment, the door panel of the car door is suspended on support rollers on a rail in the door header of the car door, which support rollers are configured to move the door panel along the trajectory determined by the aforementioned rail.

In an example embodiment, a door operator of an automatic door is fixed to the door header of the car door, with which door operator the aforementioned door panel is driven.

In an example embodiment, the door panel of a hoistway door is suspended on support rollers on a rail in the door header of the hoistway door, which support rollers are configured to move the door panel along the trajectory determined by the aforementioned rail.

In an example embodiment, in the bottom frame member of a hoistway door is a groove or ledge, and in the bottom part of the door panel of the hoistway door is a guide shoe, which is configured to travel in the groove/on the ledge that is in the bottom frame member of the hoistway door.

In the method for installing an elevator, two or more door frames of a hoistway door as well as the door frame of the car door are assembled from element pieces, a fixing point is made in the determined point of the element piece of the door header in each frame of a hoistway door for fixing a marking piece indicating the position in the elevator hoistway of the entrance to the elevator hoistway, a fixing point is made in the determined point of the element piece of the door header of the car door for fixing the reader configured to read the aforementioned marking piece, and the dimensions of the element pieces forming each aforementioned frame of a hoistway door are matched to the dimensions of the element pieces forming the frame of the car door in such a way that the interpositioning of the fixing point of a marking piece and the fixing point of a reader on the door frames of the car door and a hoistway door that are facing each other is constant when the top surface of the bottom frame member of the car door is situated at the same height as the top surface of the bottom frame member of the hoistway door.

In an example embodiment, the aforementioned marking piece is immovably fixed to the aforementioned fixing point of the marking piece and also the aforementioned reader is immovably fixed to the aforementioned fixing point of the reader.

The preceding summary, as well as the additional features and additional advantages of the invention presented below, will be better understood by the aid of the following description of some embodiments, said description not limiting the scope of application of the invention.

DETAILED DESCRIPTION OF EXAMPLE EMBODIMENTS

Figure 1:
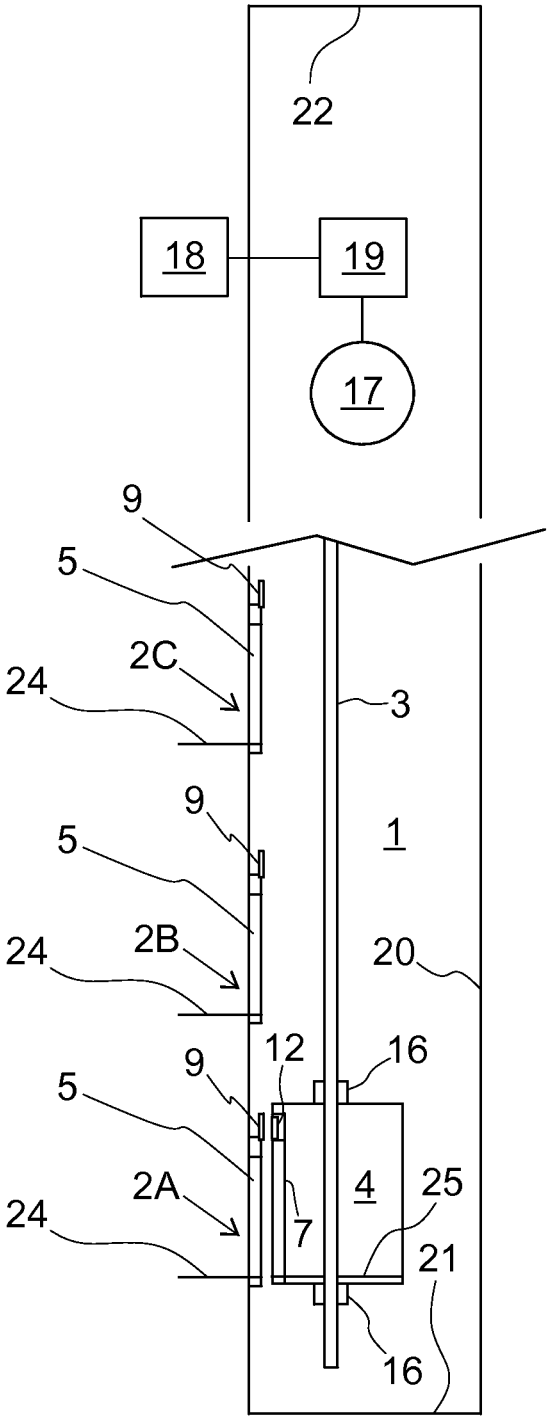
FIG. 1 illustrates a diagrammatic view of an elevator system according to an example embodiment.

The elevator system of FIG. 1 comprises an elevator car 4, which is driven in the elevator hoistway 1 along a vertical trajectory determined by guide rails 3. The elevator car 4 has guide shoes 16, such as sliding guide shoes or roller guide shoes, which slide/roll along the guide rails 3.

The elevator car 4 is driven in the elevator hoistway with a drive motor 17 via rope traction or belt traction, on the basis of elevator calls to be given with call-giving devices disposed in the elevator car 4 as well as on the stopping floors 24. The speed of the elevator car 4 is adjusted according to the target value for the speed of the elevator car calculated by the elevator control unit 18. The elevator car 4 is moved between the entrances 2A, 2B, 2C to the elevator hoistway according to the aforementioned target value for speed in such a way that when the elevator car 4 starts moving from the departure floor 2A, 2B, 2C the speed of the elevator car 4 at first gradually accelerates to the permitted maximum speed, and the elevator car 4 is driven at the permitted maximum speed until the speed again starts to be decelerated in such a way that the speed gradually decreases to zero when the elevator car 4 arrives at the stopping floor 2A, 2B, 2C. The speed of the elevator car 4 is adjusted by adjusting the flow of electric power in the drive motor 17 of the elevator with the frequency converter 19.

In the building the elevator hoistway 1 is formed in a space bounded by the wall part 20 of the elevator hoistway, the floor 21 and the roof 22. The elevator system of FIG. 1 is without machine room, in which case the drive motor 17 and the frequency converter 19 are disposed in the elevator hoistway 1, but in some embodiments the elevator system has a machine room, in which case the elevator system comprises a separate machine room in which the drive motor 17, frequency converter 19 and elevator control unit 18 are disposed.

FIG. 1 presents for the sake of clarity only the features that are essential from the viewpoint of understanding the invention. Consequently certain elevator components, such as the counterweight, traction ropes/traction belt of the elevator, call-giving devices, end buffers, machinery brakes and safety gear are not presented in FIG. 1.

A marking piece 9 is fitted in connection with the entrance 2A, 2B, 2C to the elevator hoistway on each floor, which marking piece is read by a reader 12 moving along with the elevator car 4, which reader is configured to read the marking piece 9 only when the reader 12 is situated opposite the marking piece 9 in the immediate proximity of the marking piece. The marking piece indicates to the reader 12 the location of the elevator car in the door zone at the point of the entrance 2A, 2B, 2C to the elevator hoistway, i.e. at the point at which passengers are able to transfer unobstructed between the stopping floor 24 and the elevator car 4. When the center point of the marking piece 9 and the center point of the reader 12 are face-to-face in the horizontal direction, the stopping floor 24 and the floor 25 of the elevator car are situated at the same height. The elevator car 4 starts moving from a door zone from the point of the center point of the marking piece 9 and stops in a door zone at the point of the center point of the marking piece 9 in the elevator hoistway. The elevator control unit 18 receives information about an arrival in the door zone from the reader 12 via a traveling cable. In one preferred embodiment of the invention a reader described in international patent application WO 2010018298 A is used, with which the magnetic field formed by a permanently-magnetized marking piece described in the same patent application is read, as well as an RFID identifier to be fixed to the permanently-magnetized marking piece. This type of combination of a marking piece 9 and reader 12 enables the precise measurement of the location of the marking piece 9 and also, by the aid of the RFID identifier, the marking pieces 9 can be individualized and distinguished from each other. The marking piece 9 can, however, be implemented in some other way than what is described in the aforementioned patent application, and any suitable physical property whatsoever can in this case be used for the marking in the marking piece 9 (magnetism, electromagnetism, optics, electrical conductivity, conductivity of magnetic flux, sound waves, et cetera), which is read from the marking piece 9 by a reader 12 configured to read the aforementioned property.

If the marking piece 9 is situated in the incorrect spot in the vertical direction, a step forms between the stopping floor 24 and the floor 25 of the elevator car, which step makes the transfer of passengers between the elevator car and the stopping floor 24 awkward, causing inter alia a risk of tripping. A step also impedes e.g. the transfer of a wheelchair or castor pallet into the elevator car 4 or out of the elevator car 4. For preventing the formation of a step the fixing of the marking pieces 9 and of the reader 12 is implemented in the manner presented in the following.

Figure 2B:
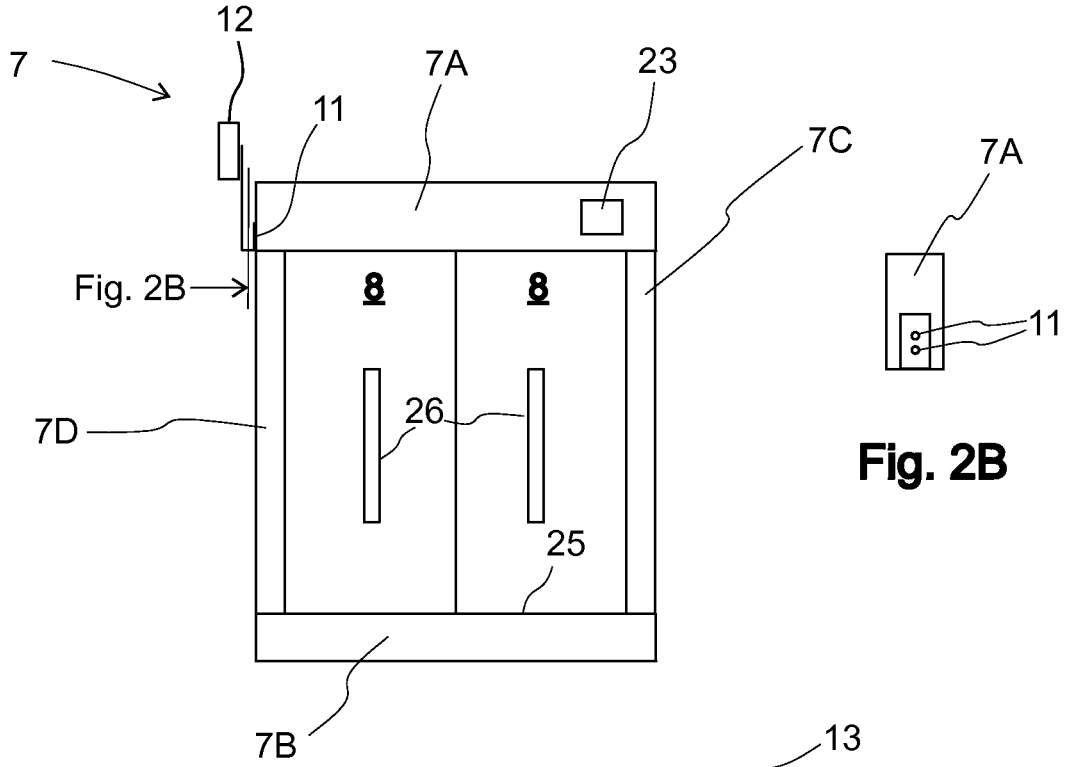
FIG. 2*b* illustrates the fixing of the reader on the frame of the car door of FIG. 2*a* in more detail as viewed from the left-hand side.
Figure 2A:
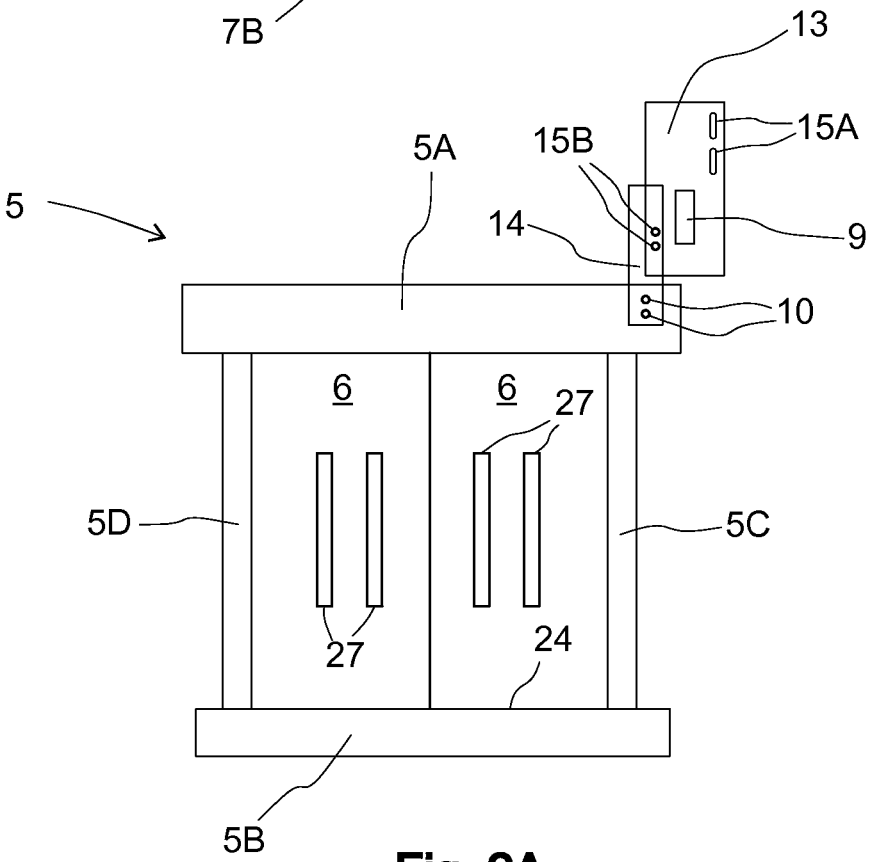
FIG. 2*a* illustrates a front view of the structure of the frames of the car door and a hoistway door in the elevator system of FIG. 1.

FIG. 2*a* presents a door opening of an entrance 2A, 2B, 2C to the elevator hoistway 1 in the elevator system of FIG. 1 as viewed from the elevator hoistway and a door opening of the elevator car 4 as viewed from outside the elevator car 4.

The entrance 2A, 2B, 2C from the floor level 24 into the elevator hoistway 1 is bounded by the frame 5 of the hoistway door, to which the door panels 6 of the hoistway door are fitted. The planar frame of the hoistway door is formed from element pieces, i.e., from a horizontal door header 5A and a bottom frame member 5B as well as from side frame members 5C, 5D connecting them. The door panels 6 of the hoistway door are suspended by support rollers on a rail in the door header 5A of the hoistway door, said rail being in the direction of the door header 5A of the hoistway door, which support rollers are configured to move the door panels 6 along the rail. In the bottom frame member 5B of the hoistway door is a groove or ledge, and in the bottom part of the door panels 6 of the hoistway door are guide shoes, which are configured to travel in the groove/on the ledge that is in the bottom frame member of the hoistway door in such a way that the door panels 6 remain in the door frame 5 when moving. The marking piece 9 is fixed immovably to the door header 5A of the hoistway door at the point of the holes 10 in the door header 5A. In one embodiment of the invention at least one of the side frame members 5C, 5D of a hoistway door is hollow, and the elevator control unit 18 is disposed inside the aforementioned hollow side frame member 5C, 5D. The side frame member also comprises a lockable swing door opening into the stopping floor, via which a serviceman gains access to the elevator control unit 18 that is inside the side frame member 5C, 5D.

The door opening of the elevator car is bounded by the frame 7 of the car door, onto which frame the door panels 8 of the car door are fitted. Also the planar frame of the car door is formed from element pieces, i.e., from a horizontal door header 7A and a horizontal bottom frame member 7B as well as from side frame members 7C, 7D connecting them. The door panels 8 of the car door are suspended by support rollers on a rail in the door header 7A of the car door, said rail being in the direction of the door header 7A of the car door, which support rollers are configured to move the door panels 8 along the rail. The car door is an automatic door, and the door operator 23 of the automatic door is fixed to the door header 7A of the car door, with which door operator the door panels 8 are driven. In the door panels 8 of the car door is a door coupler 26, and in the door panels 6 of the hoistway doors are counterparts 27 for the door coupler. In a door zone the door coupler 26 of the car door connects with the counterpart 27 of the door coupler on the hoistway door 6 situated opposite it in such a way that the hoistway door 6 can be opened by driving the door panels 8 of the car door with the door operator 23. The reader 12 of a marking piece is attached to a support arm, which is fixed immovably to the door header 7A of the car door with screws at the point of the holes 11 in the door header 7A, see FIG. 2*b*.

The element pieces 5A, 5B, 5C, 5D, 7A, 7B, 7C, 7D of the frame of a hoistway door and of the frame of the car door comprise interfaces, at the point of which the element pieces are connected to each other.

In some embodiments the element pieces 5A, 5B, 5C, 5D, 7A, 7B, 7C, 7D are fixed to each other with some prior-art joint, such as e.g. with a screw joint; the element pieces 5A, 5B, 5C, 5D, 7A, 7B, 7C, 7D can also be shaped to comprise tongues, springs, et cetera, by the aid of which the joining can occur without separate fixing means.

In some embodiments the element pieces 5A, 5B, 5C, 5D, 7A, 7B, 7C, 7D that are joined together are fixed to the surrounding structure.

The top surface of the bottom frame member 5B of a hoistway door is on the same level as the stopping floor 24 and the top surface of the bottom frame member 7B of car door is on the same level as the floor 25 of the elevator car.

The support arm 14 of the marking piece continues to the side of the door header 5A of the hoistway door in such a way that the marking piece 9 fixed to the support arm 14 is at least partly situated on the same plane in the vertical direction as the frame 5 of the hoistway door. The reader 12 is fixed to the door header 7A of the car door with a support arm, which continues to the side of the door header 7A of the car door in such a way that the reader 12 fixed to the support arm is at least partly situated on the same plane in the vertical direction as the frame 7 of the car door. The reader 12 is situated, as viewed from the direction of FIG. 2A, on the left-hand side of the frame 7D on the plane of the frame of the car door and the marking piece 9 is situated at least partly on the right-hand side of the frame 5C on the plane of the frame of the hoistway door, in which case it is not necessary to reserve extra space between the frames 5 and 7 for the reader 12 and the marking piece, and the elevator system is thus made as space-efficient as possible. It must be noted that in FIG. 2A the frame 5 of the hoistway door and the frame 7 of the car door are shown from opposite directions, so that conversely to what is presented in FIG. 2A the marking piece 9 and the reader 12 are, in reality, situated on the same vertical line in the elevator hoistway 1 in such a way that the marking piece 9 and the reader 12 are situated facing each other when the elevator car 4 is in a door zone.

Each frame 5 of a hoistway door is matched to the frame 7 of the car door. The matching is performed by selecting the dimensions (length, width, geometry) of the element pieces 5A, 5B, 5C, 5D of the frame of the hoistway door to be compatible with the dimensions of the element pieces 7A, 7B, 7C, 7D of the frame of the car door in such a way that the interpositioning of the fixing point 10 of a marking piece on the door header 5A of a hoistway door and the fixing point 11 of a reader on the door header 7A of the car door is the same in all the entrances 2A, 2B, 2C to the elevator hoistway when the top surface of the bottom frame member 7B of the car door is situated at the same height as the top surface of the bottom frame member 5B of a hoistway door. The element pieces 5A, 5B, 5C, 5D of the frame of a hoistway door and the element pieces 7A, 7B, 7C, 7D of the frame of the car door are dimensioned in such a way that the center point of the marking piece 9 and the center point of the reader 12 are situated face-to-face in the horizontal direction at the reading point of a door zone, when the top surfaces of the bottom frame members 5B, 7B of the hoistway door and of the car door are at the same height as each other, in which case a step is not able to form between the stopping floor 24 and the floor 25 of the car door when the elevator car 4 is in the door zone. The marking piece 9 is fixed immovably to base plate 13, which is fixed immovably to the holes 15B in the support arm 14, and the support arm 14 is further fixed immovably with screws to the holes 10 in the door header 5A of the hoistway door. The base plate 13 is fixed to the support arm 14 primarily at the point of the aforementioned holes 15B; in some embodiments made at the opposite end of the base plate 13, however, are grooves 15A, by the aid of which the vertical position of the base plate can, if necessary, be adjusted. In this case the base plate 13 is turned around and the fixing is made at the point of the grooves 15A instead of the holes 15B. This can be necessary in exceptional cases, if there is a step between the stopping floor 24 and the floor 25 of the car door despite the matching of the door frames 5, 7.

In particular, the correct length of the side frame members 5C, 5D, 7C, 7D is essentially important from the viewpoint of matching because it determines, for its part, the vertical position of the fixing points 10, 11 of the marking piece 9/reader 12 on the door headers 5A, 7A with respect to the top surfaces of the bottom frame members 5B, 7B.

In an example embodiment, the marking piece 9 fixed to the frame 5 of the hoistway door on the topmost floor comprises an end limit identifier, which bounds the top limit of permitted movement of the elevator car 4. Correspondingly, the marking piece 9 fixed to the frame 5 of the hoistway door on the bottommost floor comprises, in addition to a door zone marking, an end limit identifier that bounds the bottom limit of permitted movement of the elevator car 4. In this way the extreme limits of permitted movement of the elevator car can be precisely and reliably marked without the need for separate end limit switches to be installed in addition to the marking pieces. An end limit identifier can be implemented as a special variation of the magnetic field in a marking piece 9 and/or an RFID identifier of a marking piece can contain information that an end limit identifier is at issue. The end limit identifiers are in this case preferably implemented in such a way that the reader 12 detects an end limit identifier if the elevator car 4 continues from the door zone of the topmost/bottommost floor e.g. approx. 10-30 centimeters towards the end of the elevator hoistway. When it receives information about an arrival at an end limit identifier the elevator control unit 18 disconnects with the frequency converter 19 the power supply occurring to the drive motor 17 and also activates the machinery brakes to brake the movement of the rotor of the drive motor 17/the traction sheave of the elevator.

Example embodiments are described above by the aid of a few examples of its embodiment. It is obvious to the person skilled in the art that example embodiments are not only limited to the embodiments described above, but that many other applications are possible within the scope of the inventive concept defined by the claims.

It is obvious to the person skilled in the art that the matching of the frames 5, 7 of a hoistway door and of the car door described above can also be performed in the installation phase of an elevator, especially if the frames of a hoistway door and/or car door are not made from element pieces.

The invention claimed is:

1. An elevator system, comprising:

an elevator hoistway bounded by a surrounding structure;

two or more entrances to the elevator hoistway;

a plurality of guide rails fitted into the elevator hoistway;

an elevator car with at least one car door, wherein the elevator car is configured to move in the elevator hoistway between the two or more entrances to the elevator hoistway along a vertical trajectory determined by the plurality of guide rails, wherein, each entrance to the elevator hoistway is bounded by a first door frame, onto which a hoistway door is fitted, the first door frame of the hoistway door is formed from a first horizontal upper door header and a first horizontal lower frame member as well as first side frame members connecting the first horizontal upper door header and the first horizontal lower frame member, a door opening of the elevator car is bounded by a second door frame, onto which the at least one car door is fitted, the second door frame of the at least one car door is formed from a second horizontal upper door header and a second horizontal lower frame member as well as second side frame members connecting the second horizontal upper door header and the second horizontal lower frame member, and each entrance to the elevator hoistway includes a marking piece indicating a location in the elevator hoistway of the entrance to the elevator hoistway, wherein the marking piece is fixed immovably to a first fixing point on the first horizontal upper door header of the hoistway door, wherein the marking piece is immovably attached to a base plate including at least two fixing holes and at least two fixing grooves, the base plate is configured to be fixed to a first support arm with either of (i) a non-adjustable fixing method using the at least two fixing holes or (ii) an adjustable fixing method using the at least two fixing grooves, and the first support arm is further immovably attached to the first door frame of the hoistway door at the first fixing point on the first door frame; and a reader configured to move along with the elevator car, said reader being fixed immovably to a second fixing point on the second horizontal upper door header of the at least one car door and being configured to read the marking piece when the reader has reached an individual reading point for the marking piece in the elevator hoistway, wherein the first door frame of the hoistway door is matched to the second door frame of the at least one car door such that an interpositioning of the first fixing point of the marking piece on the first horizontal upper door header of the hoistway door and the second fixing point of the reader on the second horizontal upper door header of the at least one car door is constant when a second top surface of the second horizontal lower frame member of the second door frame is situated at a same height as a first top surface of the first horizontal lower frame member of the first door frame of the hoistway door.

2. The elevator system according to claim 1, wherein the first door frame of the hoistway door and the second door frame of the at least one car door are assembled from the first and second horizontal upper door headers, the first and second horizontal lower frame members, and the first and second side frame members, respectively.

3. The elevator system according to claim 2, wherein dimensions of the first horizontal upper door header, the first horizontal lower frame member, and the first side frame members forming the first door frame of the hoistway door are matched to respective dimensions of the second horizontal upper door header, the second horizontal lower frame member, and the second side frame members forming the second door frame of the at least one car door.

4. The elevator system according to claim 2, wherein a location of the first fixing point of the marking piece on the first horizontal upper door header, the first horizontal lower frame member, and the first side frame members of the first door frame of the hoistway door are matched to a respective location of the second fixing point of the reader on the second horizontal upper door header, the second horizontal lower frame member, and the second side frame members of the second door frame of the at least one car door.

5. The elevator system according to claim 1, wherein the at least two fixing holes are situated in a first end of the base plate and the at least two fixing grooves are situated in a second end of the base plate.

6. The elevator system according to claim 1, wherein the base plate is configured to be fixed to the first support arm primarily with the non-adjustable fixing method.

7. The elevator system according to claim 1, wherein the marking piece includes a floor marking for individualizing a stopping floor of the elevator car, and wherein the reader is configured to read the floor marking.

8. The elevator system according to claim 1, wherein the marking piece includes an end limit identifier for indicating a limit of permitted movement of the elevator car, and wherein the reader is configured to read the end limit identifier.

9. The elevator system according to claim 1, wherein the first support arm continues to a first side of the first horizontal upper door header of the hoistway door such that the marking piece fixed to the first support arm is at least partly situated on a same plane in a vertical direction as the first door frame of the hoistway door, and wherein the reader is fixed to the second horizontal upper door header of the at least one car door with a second support arm, wherein the second support arm continues to a second side of the second horizontal upper door header of the at least one car door such that the reader fixed to the second support arm is at least partly situated on the same plane in the vertical direction as the second door frame of the at least one car door.

10. A method for installing an elevator, the method comprising:

assembling two or more first door frames of a hoistway door and a second door frame of at least one car door from respective element pieces, wherein, a first fixing point is made at a point of the respective element piece of a first door header in each first door frame of the hoistway door so as to fix a marking piece indicating a position in an elevator hoistway of an entrance to the elevator hoistway, the marking piece is immovably attached to a base plate including at least two fixing holes and at least two fixing grooves, the base plate is configured to be fixed to a first support arm with either of (i) a non-adjustable fixing method using the at least two fixing holes or (ii) an adjustable fixing method using the at least two fixing grooves, the first support arm is further immovably attached to the first door frame of the hoistway door at the first fixing point on the first door frame, a second fixing point is made at a point of the respective element piece of a second door header in the second door frame of the at least one car door so as to fix a reader configured to read the marking piece, and dimensions of the respective element pieces forming each first door frame of the hoistway door are matched to respective dimensions of the respective element pieces forming the second door frame of the at least one car door such that an interpositioning of the first fixing point of the marking piece and the second fixing point of the reader on the respective door frames of the at least one car door and the hoistway door that are facing each other is constant when a second top surface of a second bottom frame member of the at least one car door is situated at a same height as a first top surface of a first bottom frame member of the hoistway door.

11. The method according to claim 10, wherein the marking piece is immovably fixed to the first fixing point of the marking piece, and wherein the reader is immovably fixed to the second fixing point of the reader.

* * * * *